United States Patent [19]

Johnson

[11] Patent Number: 5,049,090

[45] Date of Patent: Sep. 17, 1991

[54] ELECTRICAL CONNECTOR

[75] Inventor: Marvin T. Johnson, Bothell, Wash.

[73] Assignee: Applied Microsystems Corporation, Redmond, Wash.

[21] Appl. No.: 475,142

[22] Filed: Feb. 2, 1990

[51] Int. Cl.[5] ..... H01R 9/07

[52] U.S. Cl. ..... 439/493; 439/329

[58] Field of Search ..... 439/67, 77, 72, 492, 439/495, 496, 55, 493, 329

[56] References Cited

U.S. PATENT DOCUMENTS

| | | | |
|---|---|---|---|
| 4,468,074 | 8/1984 | Gordon | 439/72 |
| 4,548,460 | 10/1985 | Dózsa et al. | 439/77 |
| 4,717,345 | 1/1988 | Gordon et al. | 439/496 |
| 4,770,645 | 9/1988 | Antes | 439/329 |

FOREIGN PATENT DOCUMENTS

| | | | |
|---|---|---|---|
| 2155251 | 9/1985 | United Kingdom | 439/66 |

*Primary Examiner*—Larry I. Schwartz
*Assistant Examiner*—Hien D. Vu
*Attorney, Agent, or Firm*—Stoel Rives Boley Jones & Grey

[57] ABSTRACT

An electrical connector (10) provides mechanical coupling and electrical contact between the multiple wires (12) of a flat cable assembly (14) and multiple electrically conductive pads (18) of a printed circuit board (16). The electrical connector includes a substantially rigid electrically nonconductive spacing element (30) having first and second opposed side margins (32 and 34) that include respective comb-like portions (35*a* and 35*b*) shaped in alternating tabs (36) and slots (40). The slots and tabs are adapted to respectively receive and hold in spaced-apart relation the wires of the flat cable assembly. A resilient material (42) that is electrically conductive in directions only substantially parallel to a conduction axis (44) is secured between the substrate and the spaced-apart wires held by the spacing element. The resilient material provides multiple separate electrically conductive pathways between the wires and the conductive pads. An alternative electrical connector (90) includes a support element (92) having multiple spaced-apart tongues (98) that fit into grooves (118) in a support block (93). Channels (104) in the leading edges (102) of the tongues guide the wires of the flat cable assembly into the support block, which secures the wires in place and has in the bottom thereof openings (124) through which the wires protrude for electrical contact with the printed circuit board.

24 Claims, 5 Drawing Sheets

ELECTRICAL CONNECTOR

TECHNICAL FIELD

The present invention relates to electrical connectors and, in particular, to an electrical connector that provides mechanical coupling and electrical contact between closely spaced, electrically isolated wires and an electrically conductive substrate such as a printed circuit board.

BACKGROUND OF THE INVENTION

Many conventional electronic devices employ cable assemblies that include many electrically isolated wires to provide multiple electrically conductive pathways between different electronic circuits. Such circuits are typically formed on separate printed circuit boards, and the wires are typically held in side-by-side relation to form a ribbon-type or flat cable assembly.

Currently available electrical connectors providing mechanical coupling and electrical contact between printed circuit boards and flat cable assemblies have center-to-center spaces of least 0.635 millimeter between next adjacent wires. In some electronic devices, however, design constraints such as miniaturization require that the electrical conductors be spaced apart by distances of less than 0.635 millimeter. As an example, data communication between some electronic devices requires a large number of separate wires (e.g., 50 or more), connections for which could require an inordinately large amount of surface area on a printed circuit board. As another example, the size of the printed circuit boards of a relatively small electronic device might have to be increased substantially to accommodate a conventional electrical connector.

To meet such design constraints, product designers use flat cable assemblies in which the spacing between next adjacent wires is relatively small (e.g., 0.422 millimeter). Since connectors for cables with such closely spaced wires are unavailable, the separate electrical conductors in the flat cable are soldered directly to the printed circuit board. Connecting the wires in such a manner provides acceptable mechanical coupling and electrical contact. However, it is extremely difficult even for very talented technicians to solder closely spaced wires with consistent accuracy and reliability.

SUMMARY OF THE INVENTION

An object of the present invention is, therefore, to provide an electrical connector for achieving mechanical coupling and electrical contact between an electrically conductive substrate and multiple electrically isolated wires.

Another object of this invention is to provide such a connector in which the wires are arranged as a flat cable assembly.

A further object of this invention is to provide such a connector that is compatible with closely spaced apart wires.

An electrical connector of the present invention is capable of providing mechanical coupling and electrical contact between an electrically conductive substrate and multiple closely spaced electrically isolated wires arranged as a flat cable assembly. In a first preferred embodiment, the connector includes a substantially rigid, electrically nonconductive spacing element having first and second side margins, each of which including comblike portions shaped in alternating tabs and slots. The wires of the flat cable assembly are held in the slots between next adjacent tabs.

A resilient material that is electrically conductive in directions only substantially parallel to a conduction axis is secured between the substrate and the closely spaced, electrically isolated wires held by the spacing element to provide multiple separate electrically conductive pathways between the wires and the substrate. The resilient material may include, for example, a silicone rubber material through which thin wires or metallic fibers extend along the conduction axis. The resilient material is positioned between the substrate and the spacing element such that the resilient material is compressed against each of the wires held by the spacing element, thereby to provide secure mechanical coupling and electrical contact between the substrate and the wires.

In a second preferred embodiment, the connector includes a support element having multiple spaced-apart tongues that fit into grooves in a support block. Channels in the leading edges of the tongues guide the wires of the flat cable assembly into the support block, which secures the wires in place and has in the bottom thereof openings through which the wires protrude. The electrically conductive resilient material is positioned between the substrate and the bottom of the support block such that the resilient material is compressed against each of the wires protruding from the support block, thereby to provide secure mechanical coupling and electrical contact between the substrate and the wires.

Additional objects and advantages of the present invention will be apparent from the following detailed description of preferred embodiments thereof, which proceeds with reference to the accompanying drawings.

DETAILED DESCRIPTION OF PREFERRED EMBODIMENTS

Figure 1:
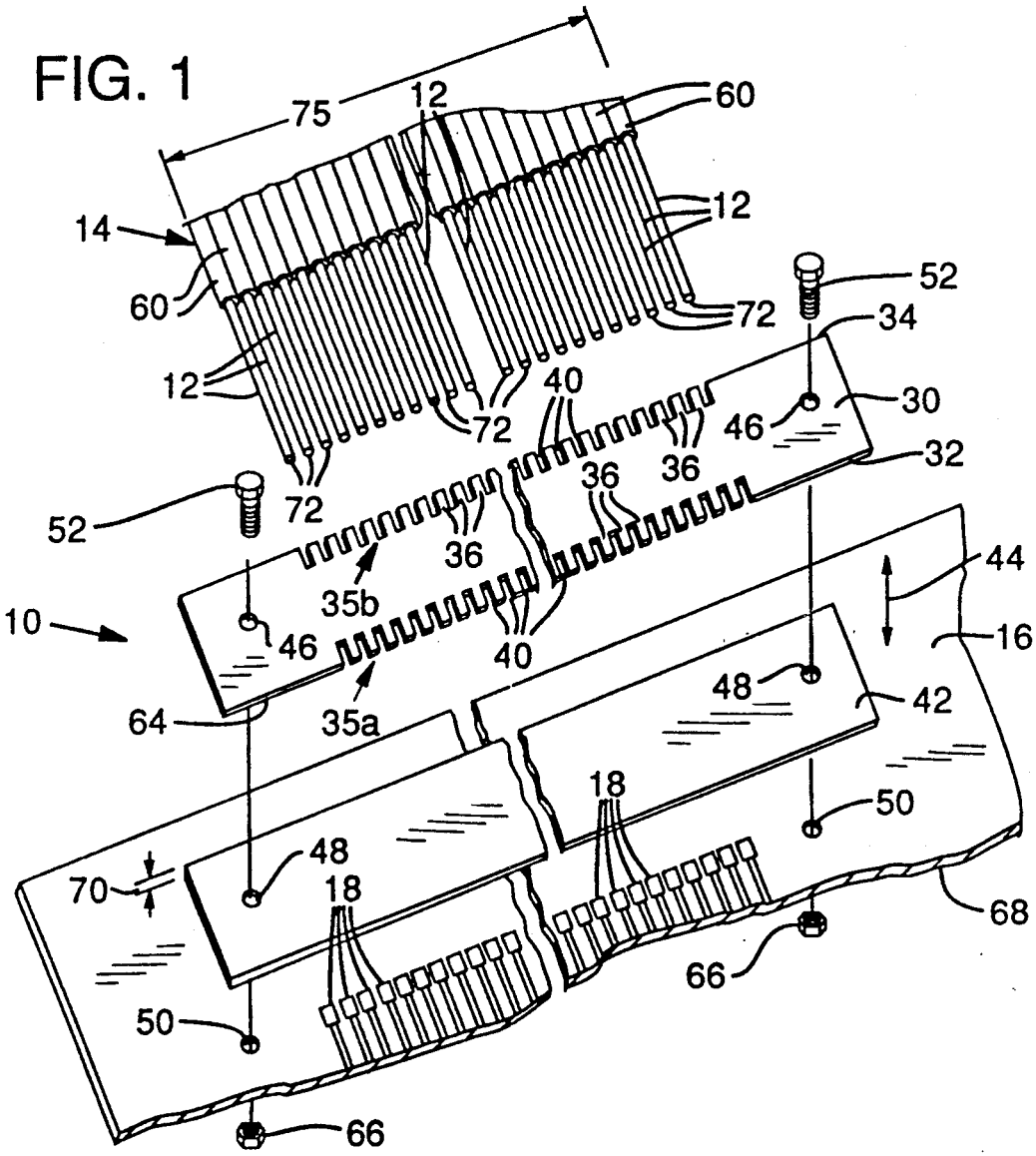
FIG. 1 is an fragmentary exploded isometric view of a first preferred embodiment of an electrical connector of the present invention positioned to connect a flat cable assembly to a printed circuit board.

FIG. 1 is an exploded view of a first preferred embodiment of the present invention, which is designated as electrical connector 10 and is positioned to provide electrical and mechanical connections between multiple electrically isolated wires 12 of a flat cable assembly 14 and a printed circuit board 16. Circuit board 16 is of the type that includes multiple spaced-apart electrically conductive pads 18, each of which is electrically connected to one of the wires 12 in flat cable assembly 14.

Figure 2:
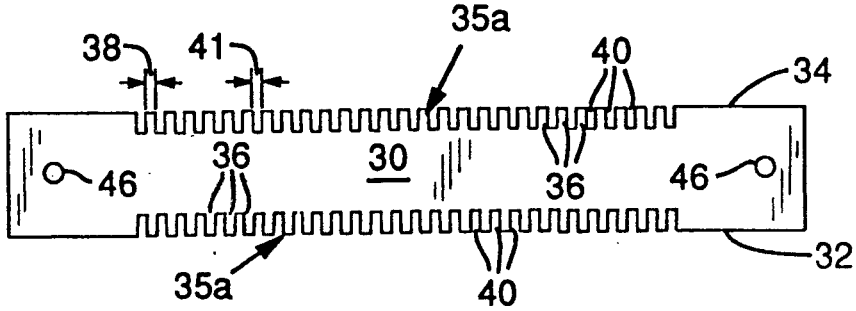
FIG. 2 is a plan view of a spacing element employed in the electrical connector of FIG. 1.

With reference to FIGS. 1 and 2, electrical connector 10 includes a flat substantially rigid, electrically nonconductive support or spacing element 30 having a first side margin 32 and a ° second side margin 34 located on opposite sides and along the length of spacing element 30. Each of the side margins 32 and 34 includes respective comb-like portions 35*a* and 35*b* shaped in alternating tabs 36 of widths 38 and slots 40 of widths 41. A flat cable assembly 14 characterized by 0.2 millimeter diameter wires with 0.4191 millimeter center-to-center spacing would match with a spacing element 30 having tab widths 38 of 0.1778 millimeter and slot widths 41 of 0.2413 millimeter. Spacing element 30 is preferably of rectangular shape and formed of a thin, rigid anodized aluminum material by means of a conventional machining process. Spacing element may be made from other electrically nonconductive materials, such as machined plastic or tooled plastic.

A resilient material 42 that is electrically conductive in directions only substantially parallel to a conduction axis 44 normal to the major surfaces of resilient material 42 is positioned between spacing element 30 and circuit board 16 to provide multiple separate electrically conductive pathways between wires 12 and conductive pads 18. Resilient material 42 may include, for example, a conductive elastomer that is known widely as "Zebra Strip" and is manufactured by several companies. Such a material includes alternate layers of conductive and nonconductive elastomers. Alternatively, resilient layer 42 could include a conductive elastomer comprising a silicone rubber through which electrically isolated thin gold wires extend in directions parallel to axis 44.

Spacing element 30 and resilient material 42 have respective pairs of holes 46 and 48 positioned near the ends thereof for axial alignment with a pair of holes 50 in circuit board 16. Each of a pair of bolts 52 passing through holes 46, 48, and 50 secures electrical connector 10 to circuit board 1 6. Holes 46 and 50 are positioned with a relatively small error tolerance of about ±0.05 millimeters to ensure that each tab 36 is in proper alignment with a corresponding conductive pad 18 on circuit board 16. The rigidity of spacing element 30 is referred to as being "substantial" because spacing element 30 can be flexible or pliant to the extent that such flexibility or pliancy does not misalign tabs 36 by more than the ±0.05 millimeter error tolerance. It will be appreciated that spacing element 30 can be included in an electrical connector kit, either alone or with resilient material 42 and bolts 52.

Figure 3:
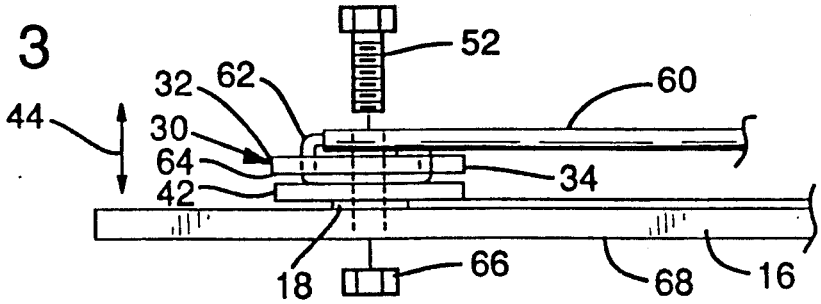
FIG. 3 is a side elevation view of the electrical connector of FIG. 1.

FIG. 3 is a side elevation view of electrical connector 10 providing electrical contact and mechanical coupling between wires 12 of cable assembly 14 and conductive pads 18 of circuit board 16. An electrically insulating material 60 providing electrical isolation of wires 12 is removed to expose bare lead portions 62 of wires 12. The lead portion 62 of each wire 12 is positioned in the slots 40 located between corresponding pairs of next adjacent tabs 36 on side margins 32 and 34 of spacing element 30. More specifically, lead portions 62 of wires 12 are wrapped around a flat surface 64 of spacing element 30 such that they extend in spaced-apart relation to each other across surface 64. In addition, wires 12 typically extend across surface 64 parallel to each other and perpendicular to side margins 32 and 34.

Resilient material 42 is positioned between the lead portions 62 of wires 12 extending across surface 64 of spacing element 30 and conductive pads 18 of printed circuit board 16. Bolts 52 extending through apertures 46, 48, and 50 are secured by nuts 66 positioned on a bottom side 68 of circuit board 16. Bolts 52 and nuts 66 are tightened such that resilient material 42 is compressed to a thickness of about 15 percent of the 0.30 millimeter uncompressed thickness 70 (FIG. 1) of resilient material 42. The rigidity of spacing element 30 and the compression of resilient material 42 together provide secure mechanical coupling and electrical contact between wires 12 and circuit board 16 in a spaced-apart arrangement corresponding to the spacing of conductive pads 18.

Figure 4A:
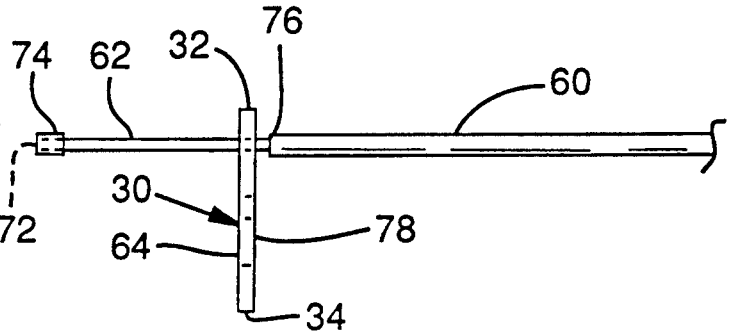
FIGS. 4A–4C are partial sectional views of a spacing element illustrating the sequential steps in the wrapping of multiple wires of a flat cable assembly around the spacing element of FIG. 2.
Figure 4B:
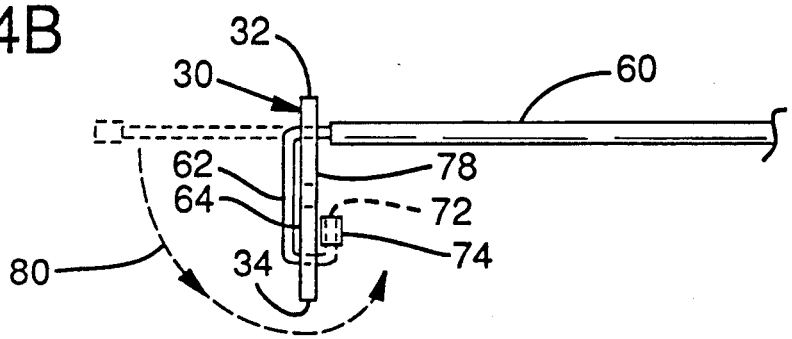
Figure 4C:
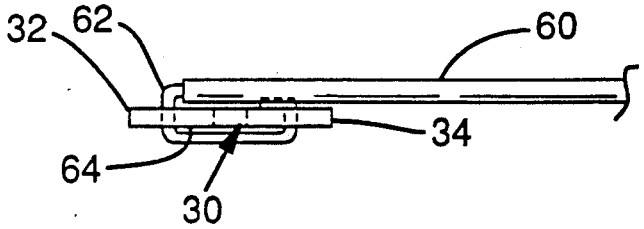

FIGS. 4A-4C illustrate the sequential steps of a method of wrapping wires 12 of cable assembly 14 around spacing element 30. With reference to FIG. 4A, a section of insulating material 60 is stripped from wires 12 to expose bare lead portions 62 extending up almost to terminal ends 72 of the wires. A small portion 74 of insulating material 60 extending along the width 75 of cable assembly 14 (FIG. 1) remains on and holds in side-by-side relation the terminal ends 72 of wires 12. Portion 74 of insulating material 60 facilitates the wrapping of wires 12 around spacing element 30 by maintaining a consistent spacing between wires 12 and by simplifying the handling of the terminal ends 72. Wires 12 are then positioned in slots 40 between next adjacent tabs 36 on side margins 32 of spacing element 30 such that a butt portion 76 of insulating material 60 is placed against a surface 78 of spacing element 30. The placement of butt portion 76 against surface 78 allows wires 12 to be wrapped tightly about spacing element 30.

FIG. 4B shows that lead portions 62 of wires 12 and portion 74 of insulating material 60 are wrapped around side 64 of spacing element 30 along a path 80. Each of the lead portions 62 of wires 12 is wrapped such that it is positioned between corresponding next adjacent pairs of tabs 36 on side margins 32 and 34. When terminal ends 72 of wires 12 are positioned on surface 78 of spacing element 30, portion 74 of insulating material 60 is removed and spacing element 30 is positioned to be substantially parallel to cable 14 (FIG. 4C).

Figure 5:
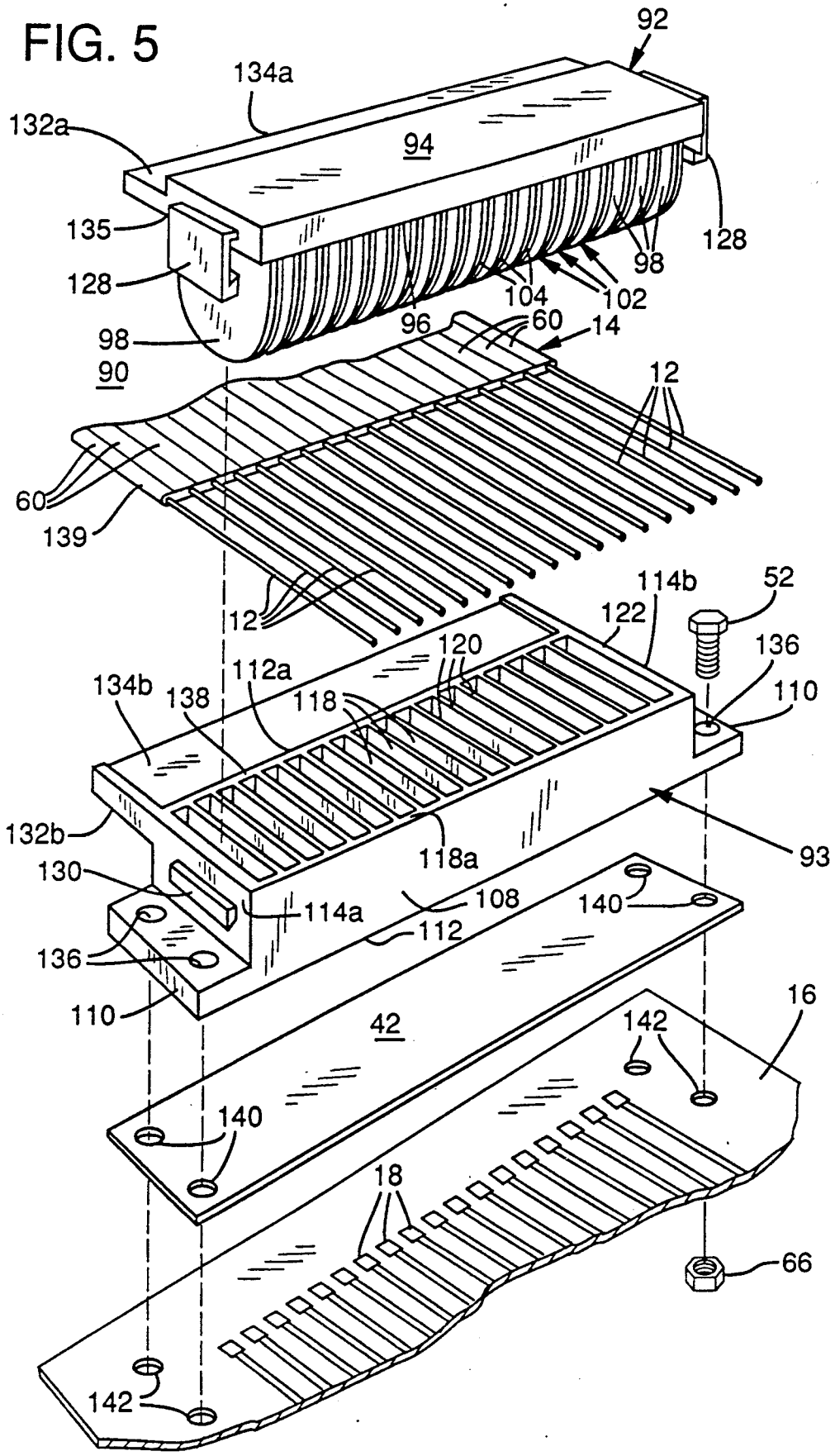
FIG. 5 is an exploded isometric view of a second preferred embodiment of an electrical connector of the present invention positioned to connect a flat cable assembly to a printed circuit board.

FIG. 5 is an exploded isometric view of a second preferred embodiment of the present invention, which is designated as electrical connector 90 and is positioned to provide mechanical coupling and electrical contact between wires 12 of flat cable assembly 14 and printed circuit board 16. Electrical connector 90 includes first and second electrically nonconductive support elements 92 and 93, respectively, between which flat cable assembly 14 is secured. Support element 92 has a base member 94 with a flat interior major surface 96 from which depend multiple arcuate tongues 98 that are uniformly spaced apart parallel to one another along the length of surface 96. Each tongue 98 has a generally parabolic leading edge 102 into which is formed a shallow, narrow channel 104 that receives one of the wires 12 of flat cable assembly 14.

Figure 8:
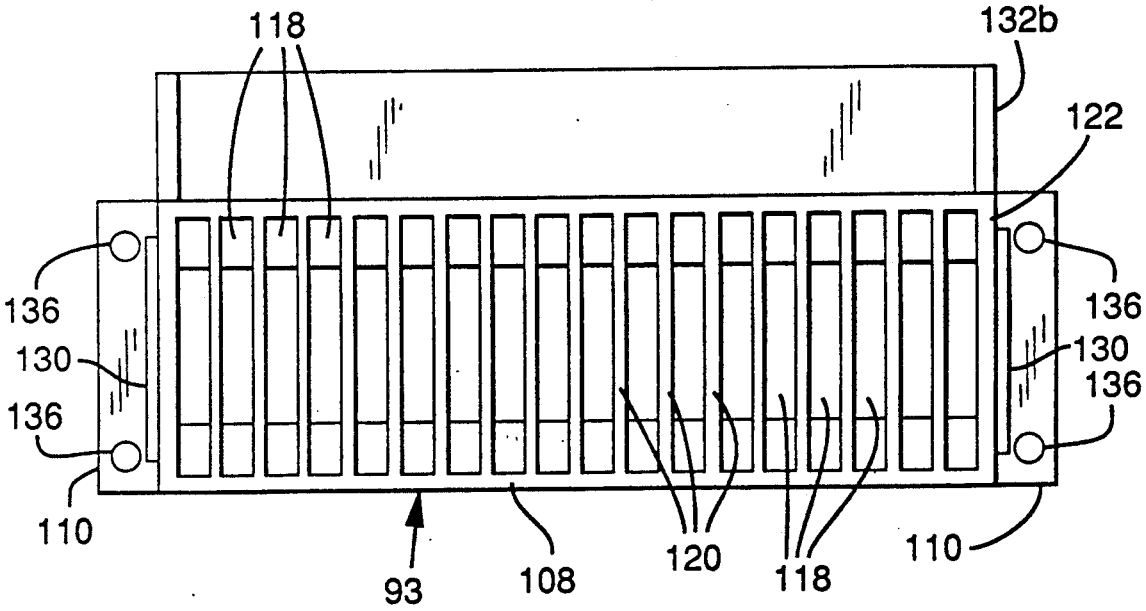
FIG. 8 is a plan view of a support element employed in the electrical connector of FIG. 5.

With reference to FIGS. 5 and 8, support element 93 comprises a rectangular block member 108 having a pair of mount flanges 110 that are positioned adjacent the lower major side or 112 of block member 108 and extend beyond its short sides 114*a* and 114*b* as shown. Multiple spaced-apart parallel grooves 118 separated by ribs 120 are formed in block member 108 and extend from its upper major side or surface 122 through its interior to lower surface 112. Grooves 118 are of complementary shape to that of the leading edges 102 of tongues 98.

Figure 6:
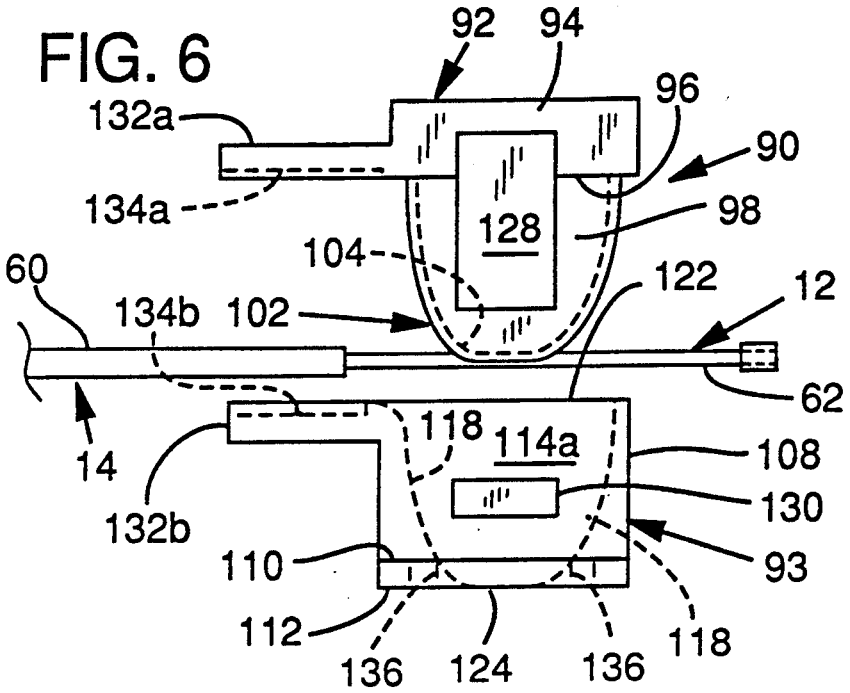
FIG. 6 is an exploded side elevation view of electrical connector of FIG. 5.
Figure 9:
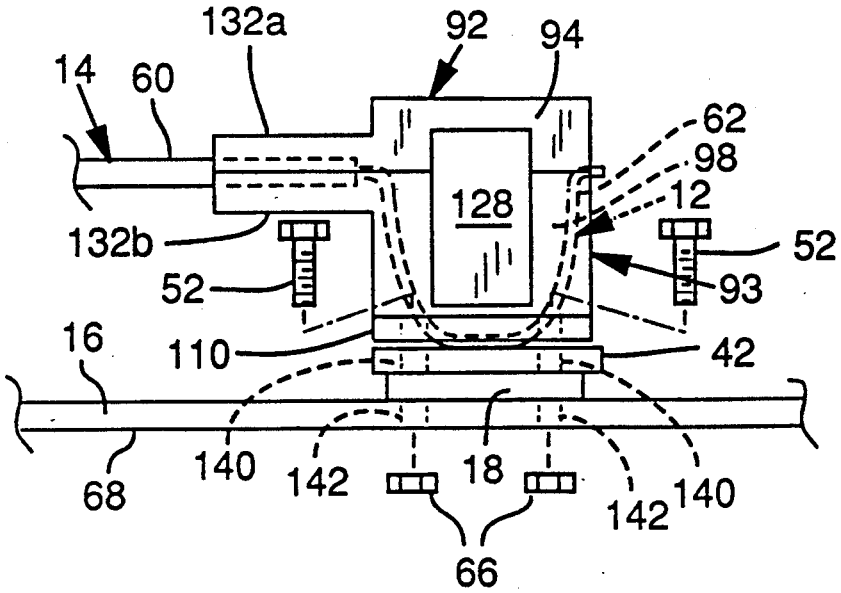
FIG. 9 is a side elevation view of the electrical connector of FIG. 5 that is shown assembled and positioned for connection to a printed circuit board.
Figure 7:
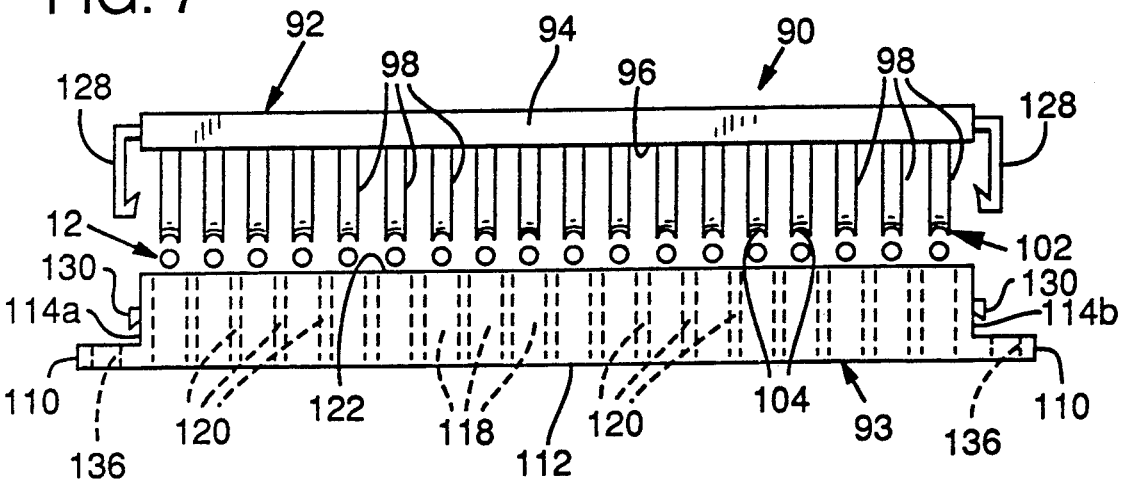
FIG. 7 is an exploded frontal elevation view of the electrical connector of FIG. 5.

The width of ribs 120 corresponds to the distance separating tongues 98 so that, when connector 90 is assembled, each of the tongues 98 of element 92 fits into a corresponding groove 118 of element 93. Leading edges 102 of tongues 98 are adapted to guide wires 12 into grooves 118 such that portions of wires 12 protrude through openings 124 (FIG. 6) in and are substantially parallel to lower surface 112.

Support elements 92 and 93 are releasibly secured together by a pair of latch fingers 128 secured to opposite ends of support element 92 and a pair of latch hooks 130 secured to short sides 114*a* and 114*b* of block member 108. A relief member 132*a* having a recessed area 134*a* projects from a side margin 135 of interior surface 96 of base member 94, and a relief member 132*b* having a recessed area 134*b* projects from a side margin 138 of the upper surface 122 of block member 108. Recessed areas 134*a* and 134*b* hold the insulated portion 139 of cable assembly 14 near the free end from which the insulation material has been previously stripped. Flexion of cable assembly 14 near electrical connector 90 is distributed over the lengths of relief members 132*a* and 132*b*, which reduce the stress on cable assembly 14 where it contacts connector 90.

With reference to FIGS. 5, 6, 7, and 9, electrically insulating material 60 is shown removed from wires 12 to expose bare lead portions 62. Lead portion 62 of each wire 12 is positioned along a channel 104 in a leading edge 102 of a tongue 98. Tongues 98 and lead portions 62 of wires 12 are inserted between ribs 120 and into grooves 118 of support element 93. Tongues 98 are shaped to hold lead portion 62 securely against grooves 118, such that a segment of lead portion 62 protrudes through opening 124 in lower surface 112 of support element 93 and fingers 128 latch onto hooks 130.

Resilient material 42 is positioned between lead portions 62 of wires 12 protruding from lower surface 112 of support element 93 and conductive pads 18 of printed circuit board 16. Bolts 52 extend through apertures 136 in flanges 110 positioned near latch hooks 130 on support element 93, and through apertures 140 and 142 in resilient material 42 and printed circuit board 16, respectively. Bolts 52 are secured by nuts 66 positioned on a bottom side 68 of circuit board 16 and are tightened such that resilient material 42 is compressed to a thickness of about 15 percent of its uncompressed thickness, as was described above with reference to FIG. 3.

It will be obvious to those having skill in the art that many changes may be made to the details of the above-described preferred embodiments of the present invention without departing from the underlying principles thereof. For example, electrical connector 10 is described as having a one-to-one relationship between the wires 12 in flat cable assembly 14 and the conductive pads 18 on printed circuit board 14. There may, of course, be fewer pads 18 to which connections are to be made; therefore, under such circumstances such a one-to-one relationship would not be necessary. The scope of the present invention should, therefore, be determined only by the following claims.

I claim:

1. An electrical connector kit having component parts capable of being assembled to provide mechanical coupling and electrical contact between an electrically conductive substrate and plural electrical conductors arranged as a flat cable assembly, the kit comprising:

a flat substantially rigid, electrically nonconductive spacing element having first and second opposed side margins along which are positioned substantially identical alternating slots and tabs that are respectively adapted to receive and hold in spaced-apart relation the electrical conductors of the flat cable assembly;

a resilient material that is electrically conductive in directions only substantially parallel to a conduction axis and is adapted to be secured between the spacing element and the substrate to provide plural separate electrically conductive pathways between the electrical conductors and the substrate; and a fastener adapted to fasten the resilient material between and in electrical contact with the substrate and the electrical conductors held on the spacing element.

2. The kit of claim 1 in which each tab and next adjacent slot having a combined width of less than about 0.635 millimeter.

3. The kit of claim 1 in which the spacing element is formed of a material selected from the group consisting essentially of anodized aluminum, machined plastic, and tooled plastic.

4. An electrical connector for providing mechanical coupling and electrical contact between an electrically conductive substrate and plural electrical conductors arranged as a flat cable assembly, comprising:

a substantially rigid, electrically nonconductive spacing element having first and second opposed side margins along which re positioned substantially identical alternating slots and tabs, the electrical conductors of the flat cable assembly being positioned within the slots so that the electrical conductors are spaced apart from each other;

a resilient material that is electrically conductive in directions only substantially parallel to a conduction axis and is secured between the spacing element and the substrate to provide plural separate electrically conductive pathways between the electrical conductors and the substrate; and securing means for securing the resilient material between and in electrical contact with the substrate and the electrical conductors held on the spacing element.

5. The connector of claim 4 in which each tab and next adjacent slot have a combined width of less than about 0.635 millimeter.

6. The connector of claim 4 in which the spacing element is formed of a material selected from the group consisting essentially of anodized aluminum, machined plastic, and tooled plastic.

7. The connector of claim 4 in which the electrically conductive substrate includes a printed circuit board.

8. An electrical connector kit having component parts capable of being assembled to provide mechanical coupling and electrical contact between an electrically conductive substrate and plural electrical conductors arranged as a flat cable assembly, the kit comprising:

a first electrically nonconductive support element having a base member with a major surface along which are positioned plural spaced-apart tongues that each have a leading edge;

a second electrically nonconductive support element having a block member through which alternating ribs and grooves extend between first and second major sides, the grooves being adapted to receive from a direction toward the first major side corresponding ones of the tongues, the leading edges of the tongues being adapted to guide the electrical conductors along the grooves such that portions of the electrical conductors protrude from the second major side;

a resilient material that is electrically conductive in directions only substantially parallel to a conduction axis and is adapted to be secured between the substrate and the electrical conductors protruding from the second major side to provide plural separate electrically conductive pathways between the electrical conductors and the substrate; and a fastener adapted to fasten the resilient material between and in electrical contact with the substrate and the electrical conductors held by the first and second support elements.

9. The kit of claim 8 in which each of the tongues is formed as a planar structure that is substantially parallel to and in face-to-face relation with a next adjacent tongue.

10. The kit of claim 8 in which each of the tongues is disposed substantially perpendicular to the base member.

11. The kit of claim 8 in which the tongues are spaced apart uniformly.

12. The kit of claim 8 in which a groove is positioned along the leading edge of each tongue to receive an electrical conductor.

13. The kit of claim 8 in which the grooves are of complementary shape to the leading edges of the tongues.

14. The kit of claim 8 further comprising connecting means for releasibly connecting the first and second support elements.

15. The kit of claim 14 in which the connecting means includes a latch finger secured to the first support element and a latch hook secured to the second support element.

16. In an electrical connector for providing mechanical coupling and electrical contact between an electrically conductive substrate and plural electrical conductors arranged as a flat cable assembly, the improvement comprising:

a first electrically nonconductive support element having a base member with a major surface along which are positioned plural spaced-apart tongues that each have a leading edge; and a second electrically nonconductive support element having a block member through which alternating ribs and grooves extend between first and second major sides, the grooves being adapted to receive from the first major side corresponding ones of the tongues, the leading edges of which being adapted to guide the electrical conductors along the grooves such that portions of the electrical conductors protrude from the second major side.

17. The connector of claim 16 in which each of the tongues is substantially perpendicular to the base member.

18. The connector of claim 16 in which the tongues are spaced apart uniformly.

19. The connector of claim 16 in which a groove is positioned along the leading edge of each of the tongues to receive an electrical conductor.

20. The connector of claim 16 in which the grooves are of complementary shape to the leading edges of the tongues.

21. The connector of claim 16 further comprising connecting means for releasibly connecting the first and second support elements.

22. The connector of claim 21 in which the connecting means includes a latch finger secured to the first support element and a latch hook secured to the second support element.

23. An electrical connector for providing mechanical coupling and electrical contact between an electrically conductive substrate and plural electrical conductors arranged as a flat cable assembly, comprising:

electrically nonconductive support means for supporting against a rigid surface predetermined lengths of the electrical conductors in substantially parallel relation to each other, the support means including first and second opposed side margins along which are positioned substantially identical alternating slots and tabs that are respectively adapted to receive and hold in spaced-apart relation the electrical conductors of the flat cable assembly;

a resilient material that is electrically conductive in directions only substantially parallel to a conduction axis and is secured between the electrical conductors supported against the rigid surface of the support means and the substrate to provide plural separate electrically conductive pathways between the electrical conductors and the substrate; and securing means for securing the resilient material between and in electrical contact with the substrate and the electrical conductors supported by the support means.

24. The connector of claim 23 in which the spacing element is flat.

* * * * *

UNITED STATES PATENT AND TRADEMARK OFFICE

CERTIFICATE OF CORRECTION

PATENT NO. : 5,049,090

DATED : September 17, 1991

INVENTOR(S) : Marvin T. Johnson

It is certified that error appears in the above-identified patent and that said Letters Patent is hereby corrected as shown below:

Column 3, line 16 after "and a" delete "°".

Column 3, line 50 change "1 6." to --16.--.

Column 5, line 5 change "mount" to --mounting--.

Column 5, line 6 after "or" insert --surface--.

Claim 1, line 6, column 6, line 12 after "flat" insert --,--.

Claim 2, line 2, column 6, line 30 change "having" to --have--.

Claim 4, line 7, column 6, line 42 change "re" to --are--.

Signed and Sealed this

Fifth Day of January, 1993

*Attest:*

DOUGLAS B. COMER

*Attesting Officer*

*Acting Commissioner of Patents and Trademarks*